United States Patent [19]

Worrell

[11] 4,215,510

[45] Aug. 5, 1980

[54] FLEXIBLE HOLLOW HOOP AND BALL

[76] Inventor: Knolly Worrell, 117-15 226th St., Cambria Heights, N.Y. 11411

[21] Appl. No.: 918,934

[22] Filed: Jun. 26, 1978

[51] Int. Cl.[2] ..... A63H 1/32; A63H 5/00

[52] U.S. Cl. ..... 46/47; 46/114; 35/DIG. 2

[58] Field of Search ..... 35/DIG. 2; 46/47, 114, 46/220, 43, 193; 273/129 C

[56] References Cited

U.S. PATENT DOCUMENTS

| | | | |
|---|---|---|---|
| 989,944 | 4/1911 | Bramson | 46/228 |
| 1,259,889 | 3/1918 | MacDonald | 46/114 |
| 2,817,184 | 12/1957 | Inouye | 46/47 |
| 2,960,793 | 11/1960 | Van Cleave | 46/47 |
| 2,974,439 | 3/1961 | Fawick | 46/114 |
| 3,066,438 | 12/1962 | Green | 46/47 |
| 3,098,316 | 7/1963 | McCarthy | 46/47 |
| 3,167,881 | 2/1965 | Mazzadra | 46/114 |
| 3,729,860 | 5/1973 | Kargul | 46/47 |
| 3,918,708 | 11/1975 | Augusta | 46/47 |
| 4,052,982 | 10/1977 | Ozeryansky | 46/47 |

*Primary Examiner*—Louis G. Mancene
*Assistant Examiner*—Michael J. Foycik, Jr.
*Attorney, Agent, or Firm*—Howard I. Podell

[57] ABSTRACT

A hoop of hollow construction of a shape to fit substantially snugly about a user's waist which has a ball internally freely mounted in the hoop so that the ball may rotate through the interior passageway of the hoop in response to motion of the wearer's body. The hollow cavity of the hollow hoop can have ridge rings running radially across the body of the hoop, which rings can also be formed on the exterior of the hoop.

2 Claims, 4 Drawing Figures

FLEXIBLE HOLLOW HOOP AND BALL

BACKGROUND OF THE INVENTION

I have invented a new and novel flexible hollow hoop and ball. My improved hoop and ball can replace a hula hoop as an entertaining and educational toy.

Prior art references known at the time of preparation of this application include the following U.S. Pat. Nos.: 2,817,184, 2,960,793, 2,974,439, 3,066,438, 3,098,316 and 3,167,881.

BRIEF DESCRIPTION OF THE INVENTION

My improved flexible hollow hoop and ball uses a flexible hollow hoop with ridge rings along the body of the hoop and a ball contained within the central cavity of the hoop to provide an interesting and novel variation from the prior art.

BRIEF DESCRIPTION OF THE FIGURES

My invention can be understood in view of the accompanying figures.

DETAILED DESCRIPTION OF THE PREFERRED EMBODIMENT

Figure 2:
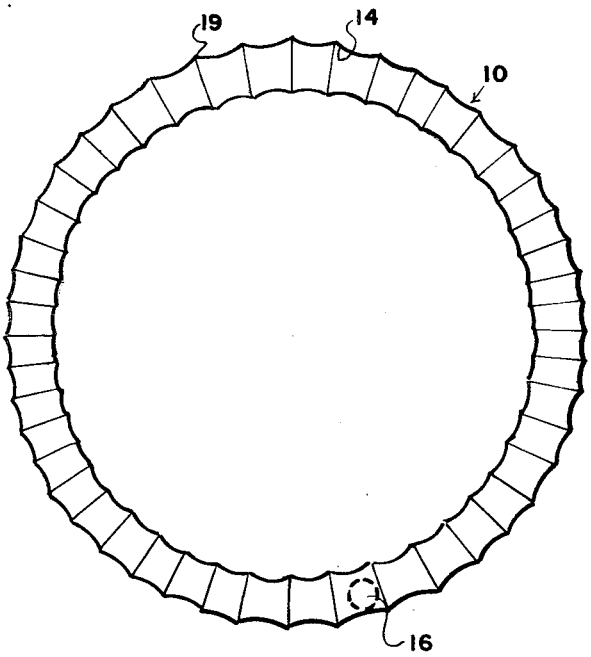
FIG. 2 is a top view of the hoop.
Figure 1:
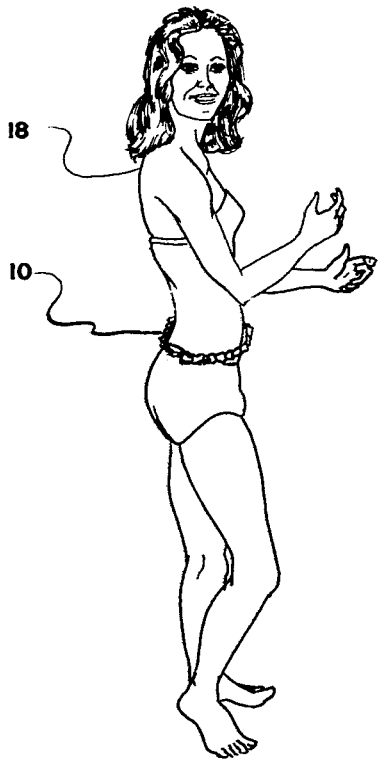
FIG. 1 is a front perspective view of the device in use on a person.
Figure 3:
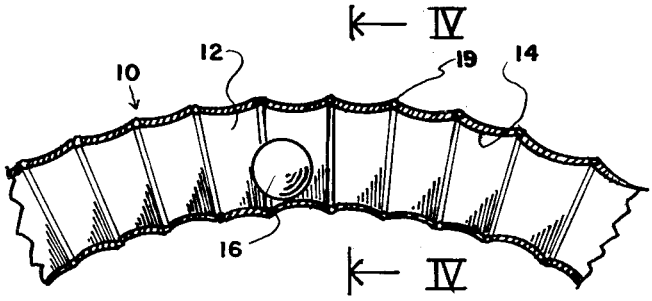
FIG. 3 is a close-up cross sectional side view of the hoop with ball mounted therein.
Figure 4:
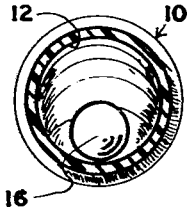
FIG. 4 is a cross sectional view taken along the plane 4—4 of FIG. 3.

With regard to FIGS. 1, 2, 3 and 4, a flexible hollow hoop 10 is seen having a central cavity 12 and ridge rings 14 running laterally across the interior surface of flexible hollow hoop 10. Within the central cavity 12 a ball is housed which can move freely through the central cavity 12 of the hoop 10 in response to movement of the hoop when worn about the body of the user 18.

The ball makes a clicking noise as it bounces off the interior ridge rings 14. Exterior ridge rings 19 serve to prevent the hoop itself from rotating in response to motion of the body of the user.

Having described a preferred embodiment of my invention, it is understood that various changes can be made without departing from the spirit of my invention, and, I desire to cover by the appended claims all such modifications as fall within the true spirit and scope of my invention.

What I claim and seek to secure by Letters Patent is:

1. A hoop comprising a hollow hoop of substantially circular cross section, wherein a ball is mounted in a central cavity of the hollow interior of said hoop, with said ball of a size to freely move in said interior, wherein the hoop is made of a semi-flexible material, and wherein the hoop has a plurality of internal ridge rings running laterally about the interior of said hoop, and projecting towards the interior of the hoop, and in which the hoop is formed with a plurality of external ridge rings on the exterior of the hoop, that project outwardly from the hoop, said hoop being of a size to fit substantially snugly about the waist of a wearer, such that a wearer may cause said ball to rotate in the interior of the hoop, with respect to said hoop, by body motion of the wearer, with said external ridge rings serving to limit rotatable motion of the hoop with respect to the wearer while each said internal ridge rings produces a clicking noise when the ball rotates about the interior of said hoop, striking a said internal ridge ring.

2. A hoop, comprising a hollow hoop of substantially circular cross-section, wherein an object is mounted in a central cavity of the hollow interior of said hoop, with said object of a size so as to be free to move through said interior, in which said hoop is of a size to substantially snugly fit about the body of a wearer, in which said hoop is formed of a semi-flexible material and fitted with a plurality of spaced first projections, each extending into the interior of the hoop so as to produce a clicking noise when the object rotates within the interior of the hoop and strikes a said first projection, as the object passes a said first projection, with said hoop formed with a plurality of spaced second projections, each extending beyond the exterior of the hoop so as to limit rotatable motion of the hoop with respect to the body of said wearer.

* * * * *